US011482794B1

(12) United States Patent
Salem et al.

(10) Patent No.: US 11,482,794 B1
(45) Date of Patent: Oct. 25, 2022

(54) SLOT-FED UNIT CELL AND CURRENT SHEET ARRAY

(71) Applicant: Ball Aerospace & Technologies Corp., Boulder, CO (US)

(72) Inventors: Matthew Salem, Westminster, CO (US); Jeffrey Godard, Boulder, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 211 days.

(21) Appl. No.: 16/876,941

(22) Filed: May 18, 2020

Related U.S. Application Data

(60) Provisional application No. 62/849,679, filed on May 17, 2019.

(51) Int. Cl.

| | |
|---|---|
| ***H01Q 21/06*** | (2006.01) |
| ***H01Q 21/00*** | (2006.01) |
| ***H01Q 1/48*** | (2006.01) |

(52) U.S. Cl.
CPC ..... *H01Q 21/062* (2013.01); *H01Q 21/0075* (2013.01); *H01Q 1/48* (2013.01); *H01Q 21/064* (2013.01)

(58) Field of Classification Search
CPC ..... H01Q 21/062; H01Q 21/064; H01Q 9/0435–0457; H01Q 19/005; H01Q 21/065; H01Q 21/0075
See application file for complete search history.

(56) References Cited

U.S. PATENT DOCUMENTS

| | | | | |
|---|---|---|---|---|
| 2004/0104860 | A1 | 6/2004 | Durham et al. | |
| 2017/0338558 | A1 | 11/2017 | West | |
| 2018/0205134 | A1* | 7/2018 | Khan | H01Q 5/314 |
| 2018/0316098 | A1* | 11/2018 | Amadjikpe | H01Q 19/005 |
| 2021/0013627 | A1* | 1/2021 | Goto | H01Q 1/48 |

FOREIGN PATENT DOCUMENTS

| | | | | |
|---|---|---|---|---|
| WO | WO-2018077408 A1 * | 5/2018 | | H01Q 21/062 |

* cited by examiner

*Primary Examiner* — Ricardo I Magallanes
(74) *Attorney, Agent, or Firm* — Sheridan Ross, P.C.

(57) ABSTRACT

Systems and methods for providing a broadband antenna are described. The systems and methods involved providing a current sheet array. The current sheet array comprises a plurality of unit cells coupled together. Each unit cell comprises a slot and a stripline feed. The stripline feed couples to a dipole array through the slot. An electric field in the slot of a first unit cell is perpendicular to one or more of the stripline feed of the first unit cell and one or more dipoles of the first unit cell.

20 Claims, 7 Drawing Sheets

SLOT-FED UNIT CELL AND CURRENT SHEET ARRAY

CROSS REFERENCE TO RELATED APPLICATION

This application claims the benefit of U.S. Provisional Patent Application Ser. No. 62/849,679, filed May 17, 2019, is the entire disclosure of which is hereby incorporated herein by reference.

FIELD

The present disclosure is generally related to antennas and more particularly to current sheet arrays.

BACKGROUND

The development of two-dimensional planar broadband antennas has been long been investigated. Typically, current sheet arrays are chosen over Vivaldi and loaded slot designs as current sheet arrays have a reduced depth, dual polarization (i.e., horizontal and vertical polarization) and small 2D element spacing. Conventional current sheet arrays comprise three modes: a radiating resonant mode, a non-radiating common mode, and a radiating dipole mode. Under normal circumstances, the non-radiating common mode existing in conventional current sheet arrays occurs at a frequency between the radiating resonant and dipole modes. This common mode thus reduces the effective bandwidth of the antenna. Many attempts have been made to mode or eliminate the common mode in order to connect the two radiating modes and produce an extremely wideband antenna.

For example, some conventional current sheet arrays have been developed with additional vias to move the resonant and common modes above the dipole mode to provide wideband performance. By doing this, the antenna is no longer electrically small compared to its radiation band (i.e., the dipole forms the low end of the radiation band). Constructing current sheet arrays with additional vias in this way can come at the expense of high band grating lobes when placed on larger lattices.

Other conventional current sheet arrays have been developed using BALUN-fed current sheet arrays in which the common mode is removed, allowing for wideband performance. However, this wideband performance comes at the expense of increased circuitry, a more difficult build procedure and a larger depth of the current sheet array. The inclusion of a BALUN with a current sheet array makes the integration with a complex feed network very difficult to manufacture.

What is needed is a current sheet array in which the common mode is eliminated without the negative aspects existing in conventional current sheet arrays. A current sheet array that is also dual polarized, small in size, easy to manufacture, capable of being curved to fit conformal applications, with no non-radiating common mode is desired.

SUMMARY

Embodiments of the present disclosure provide current sheet array antennas with broadband characteristics, and methods to broadband current sheet array antennas. Embodiments of the present disclosure can provide an antenna element design that is thin and made up of a number of unit cells, in which the array may be curved to fit conformal, volume constrained applications. The present disclosure enables a reduction in array size, for example minimizing a thickness of the array, while enabling and maintaining broad bandwidth. The broad bandwidth allows the use of fewer antennas to cover the full frequency range resulting in less volume use of the platform.

This invention uses a slot to couple onto the current sheet array. Because the electric field in the slot is perpendicular to the current sheet array, a common mode cannot exist. By eliminating the common mode, the low band resonance can be connected to a dipole mode to provide a continuous wideband performance.

As discussed above, some conventional systems use a BALUN to eliminate the common mode. Such conventional systems have a larger depth as compared to embodiments described herein. Also, the inclusion of a BALUN makes the integration with a complex feed network more difficult to manufacture as compared to embodiments described herein. The slot-coupled feed as described herein, eliminates the common mode in a planar architecture without increasing depth. The embodiments described herein are extremely simple to manufacture using traditional PCB build processes.

Also as mentioned in the Background, some conventional systems use shorting posts to reduce electrical length of the resonant and common mode loops. Although wideband performance can still be achieved with such systems, the antenna is no longer electrically small compared to its radiation band (i.e., a dipole mode forms the low end of the radiation band). The presently described current sheet array, on the other hand, does not shift the resonant band, so the antenna remains electrically small (i.e., the dipole forms the high end of the radiation band).

The current sheet array as described herein may be formed using orthogonal coupled dipole elements such as dipole arms or dipoles. Horizontal and vertical polarized radiation may be formed by balancing the capacitance between elements with the inductance of the array. The current sheet array in some embodiments uses a low impedance stripline feed which is capacitively loaded. The stripline feed excites a mode in a fixed slot which couples to elements of the current sheet array. The fixed slot mode eliminates the excitation of the common mode resonance.

The slot mode couples to the current sheet array which forms two radiating modes: a resonant loop and a dipole mode. The fixed slot mode does not excite the common mode of the current sheet array which does not radiate and reduces the antenna's effective bandwidth. The fixed slot mode allows the current sheet array to provide an extremely wide bandwidth. The design is also very easy to manufacture, is extremely thin and can be easily curved to fit conformal applications.

Embodiments of the present disclosure provide an antenna element that can be used as a single antenna or in an array. Additional features and advantages of embodiments of the disclosed antenna and/or array systems and methods will become more readily apparent from the following description, particularly when taken together with the accompanying drawings.

DETAILED DESCRIPTION

Figure 1:
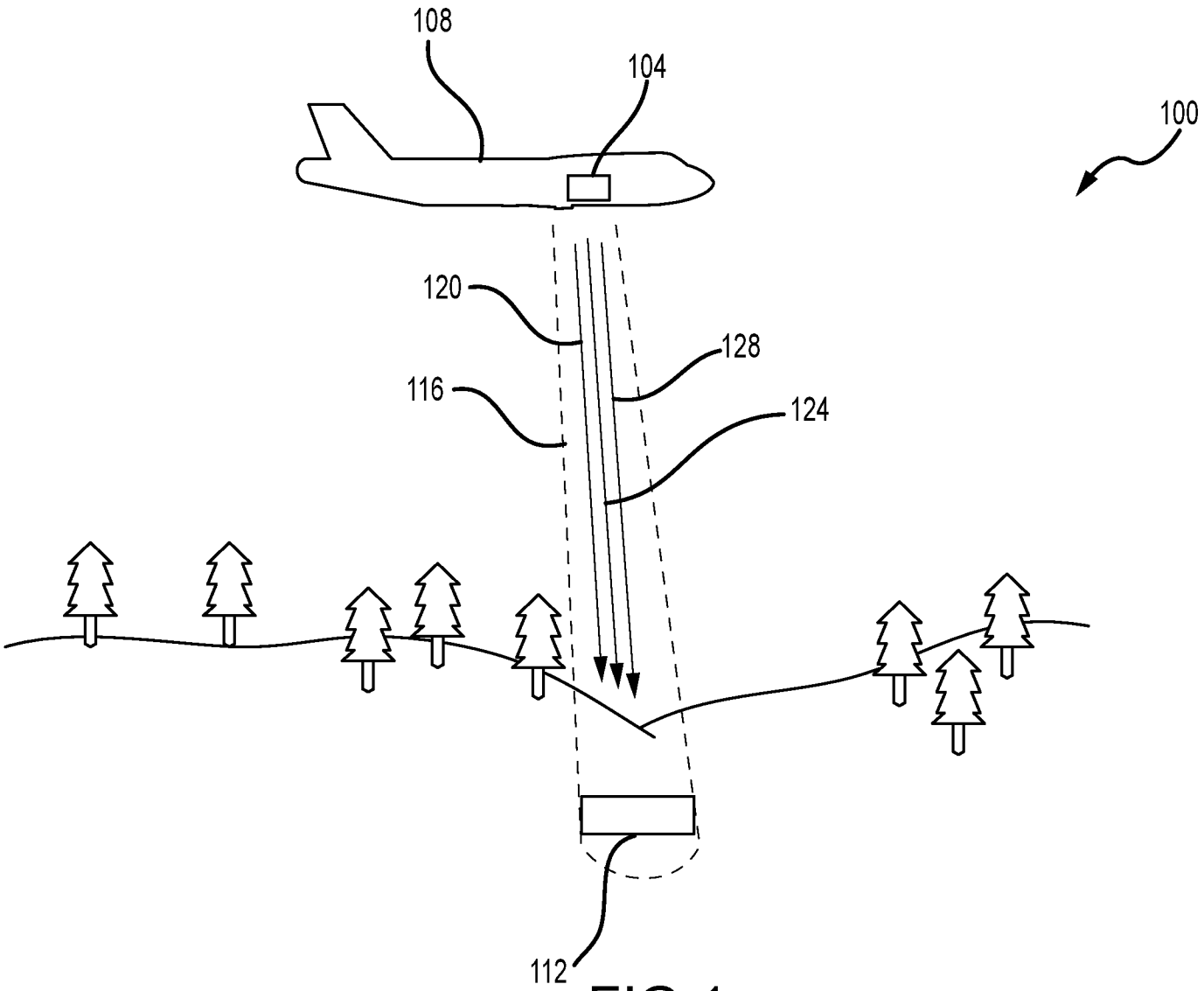
FIG. 1 depicts an environment including an antenna system incorporating an array of antenna elements in accordance with embodiments of the present disclosure.

Embodiments of the present disclosure are generally directed to an antenna that can be conformally mounted, and that provides a relatively high bandwidth. FIG. 1 illustrates an exemplary environment 100 utilizing a current sheet array 104 in accordance with one or more embodiments. A current sheet array 104 may be installed, for example, on a surface of a plane 108, satellite, or other type of vehicle. In some embodiments, a current sheet array 104 may be stationary and mounted on land, a building, or other structure. A current sheet array 104 as described herein may be capable of transmitting signals 120, 124, 128 toward a receiving device 112. A receiving device 112 may be stationary or in motion. For example, a receiving device 112 may be mounted to the surface of a plane, satellite, or other type of vehicle, or on land, a building, or other structure.

In some embodiments, a current sheet array 104 may be a computer-controlled array of antennas configured to create a beam of radio waves which may be electronically steered to point in a wide range of directions without requiring the current sheet array 104 to be physically moved. It should be appreciated that in some embodiments the current sheet array 104 may be designed to be physically moveable or stationary. In some embodiments, a current sheet array 104 as described herein may be an active or passive phased array.

In some embodiments, the current sheet array 104 may transmit the one or more signals 120, 124, 128 in the form of a beam 116. Beamforming or spatial filtering may be used for directional signal transmission or reception by the current sheet array 104. In some embodiments, adaptive beamforming may be used to detect and estimate a signal of interest. The signals 120, 124, 128 transmitted by the current sheet array 104 may be of various wavelengths. For example, signals 120, 124, 128 may be in the UHF and/or microwave bands or in other bands of wavelengths.

In some embodiments, a current sheet array 104 may be in communication with a computer system. The computer system may execute software configured to control signals transmitted by the current sheet array 104. The computer system may further be capable of processing signals received by the current sheet array 104. In some embodiments, the current sheet array 104 may be used to transmit and/or receive signals in a variety of directions at a single time. As described herein, the current sheet array 104 may utilize a wide bandwidth and be capable of transmitting the signals 120, 124, 128 at frequencies not capable of being transmitted by conventional current sheet arrays. For example, each of the signals 120, 124, 128 may be one of a low-, mid-, and high-frequency signal. While conventional current sheet arrays are limited by a non-radiating common mode, a current sheet array 104 may eliminate the common mode and be enabled to operate at a wide bandwidth. The current sheet array 104 may further be capable of detecting and receiving signals of a wide range of frequencies. For example, in addition to or as opposed to transmitting signals, a current sheet array as described herein may further be configured to detect and/or receive signals.

As described herein, antennas may be associated with a particular radiation band of the range or ranges of signal wavelengths which may be received and/or transmitted by each particular antenna.

As discussed above, some conventional current sheet arrays have been developed with a number of vias to move resonant and common modes above the dipole mode to provide wideband performance. As described herein, a current sheet array may be built which does not shift the resonant band, such that the antenna remains electrically small, wherein the dipole forms on the high end of the radiation band.

The current sheet array as described herein may be formed using orthogonal-coupled dipole elements, for example dipole arms or dipoles. Horizontal polarized ("H pole") and vertical polarized ("V pole") resonant loops may be formed by balancing the capacitance between elements with the inductance of the loops. The current sheet array in some embodiments may use a low-impedance stripline feed which may be capacitively loaded. The stripline feed excites a mode in a fixed slot which couples to elements of the current sheet array. The fixed slot mode eliminates the excitation of the common mode resonance.

The fixed slot mode couples to the current sheet array to form two radiating modes: a resonant loop and a dipole mode. The fixed slot mode does not excite the common mode of the current sheet array which does not radiate and reduces the antenna's effective bandwidth. The fixed slot mode allows the current sheet array to provide an extremely wide bandwidth. The design is also very easy to manufacture, is extremely thin and can be easily curved to fit conformal applications.

Figure 2A:
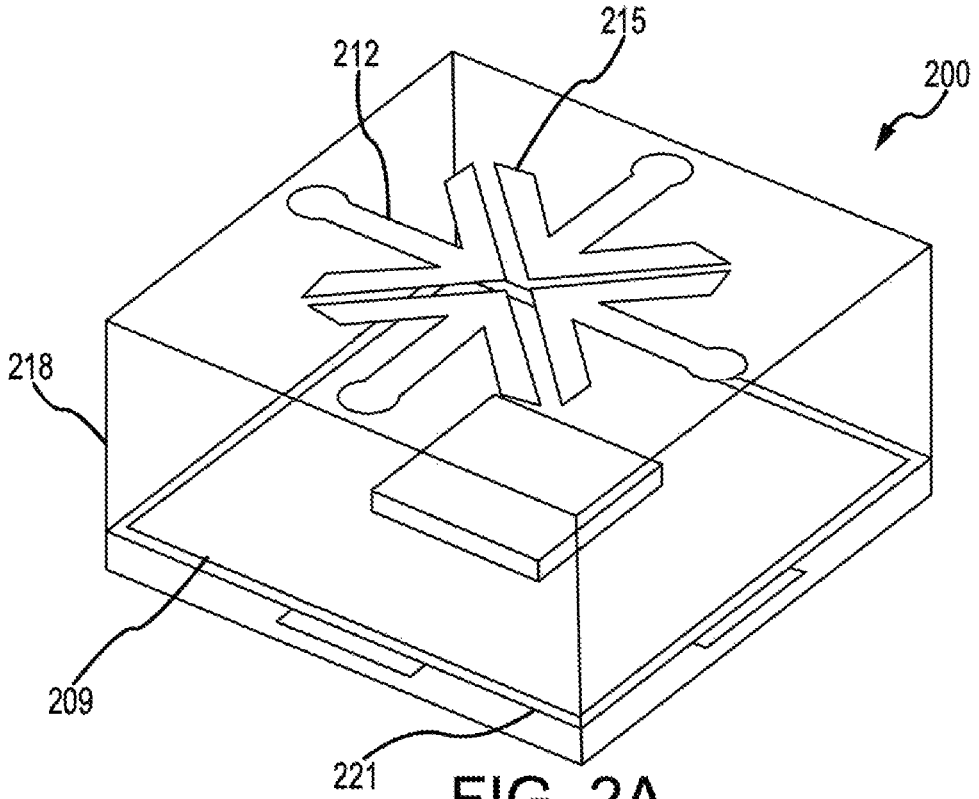
FIG. 2A is an illustration of a unit cell element in accordance with embodiments of the present disclosure.
Figure 2B:
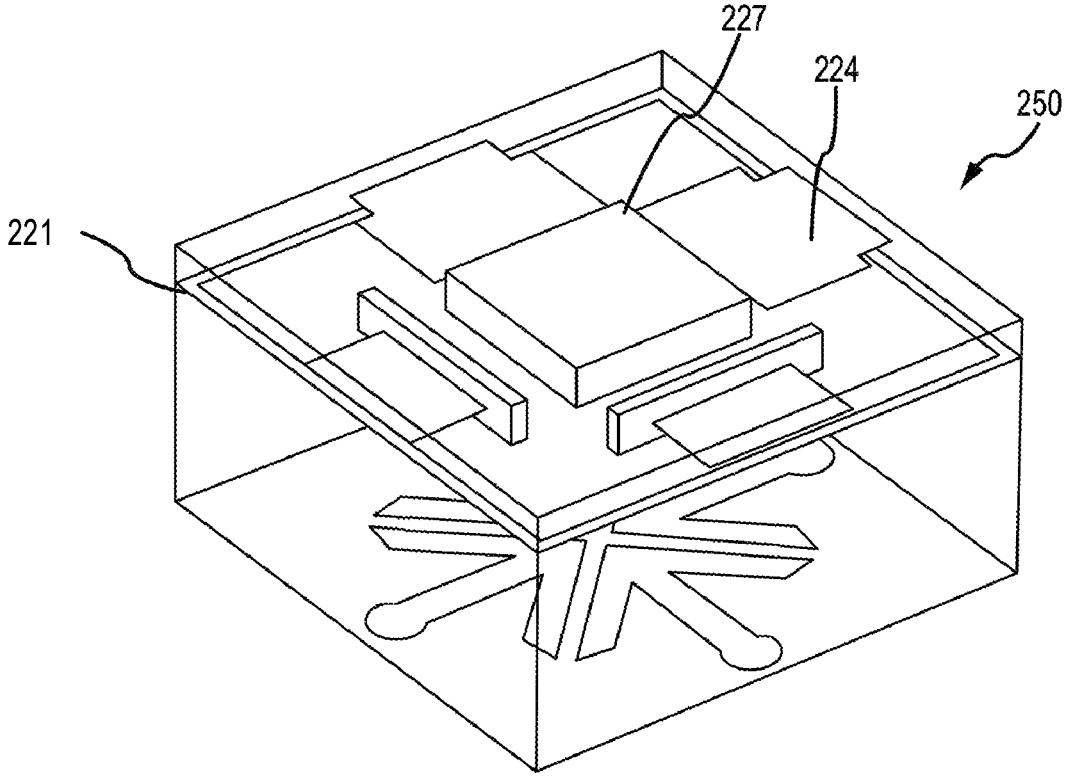
FIG. 2B is an illustration of a second view of the unit cell illustrated in FIG. 2A in accordance with embodiments of the present disclosure.

FIGS. 2A and 2B illustrate alternate angled views 200, 250 of a unit cell as used in a current sheet array in accordance with embodiments of the present disclosure.

In some embodiments, one or more the dipole arms 212 may be connected to a respective capacitive arm 215. For example, a unit cell may comprise four dipole arms and four capacitive arms. A unit cell may comprise a dielectric material 218. A slot 221 may extend around an outer edge of the unit cell. The array of arms 212, 215 may couple to a stripline feed 224 through the slot 221. The stripline feed 224 may be capacitively loaded by an edge plated section 227 connected to the ground plane 209.

Figure 3A:
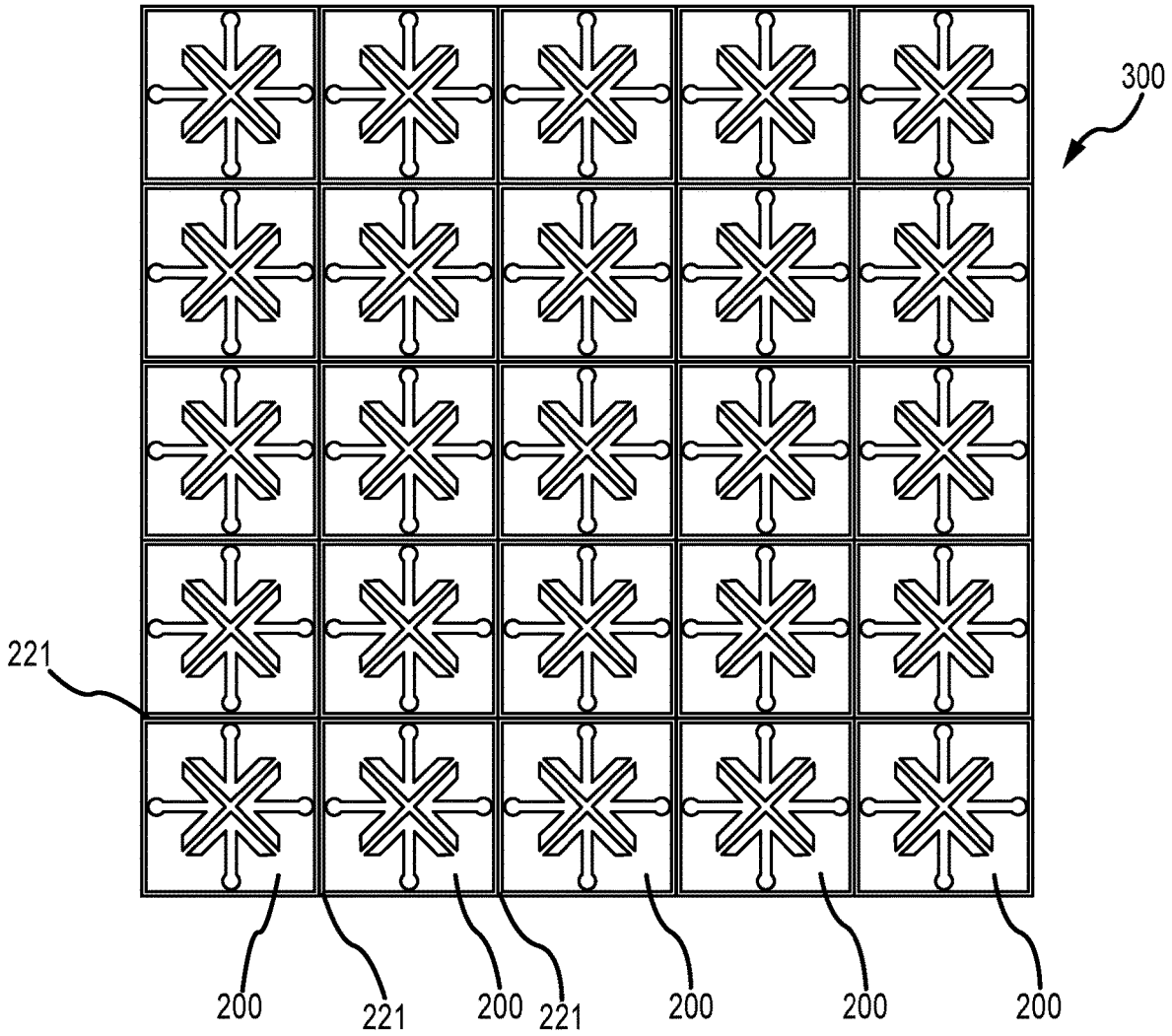
FIG. 3A is a plan view of a current sheet array in accordance with embodiments of the present disclosure.

As illustrated in FIG. 3A, a current sheet array 300 may be formed by a number of unit cells 200 arranged in a pattern such that the slots 221 of each unit cell 200 line up and create a series of horizontal and vertical slots 221, running the length and width of the current sheet array 300. While a square shape is formed by the current sheet array 300 illustrated in FIG. 3A, it should be appreciated virtually any shape may be formed by linking a number of unit cells 200 in a variety of patterns.

Figure 3B:
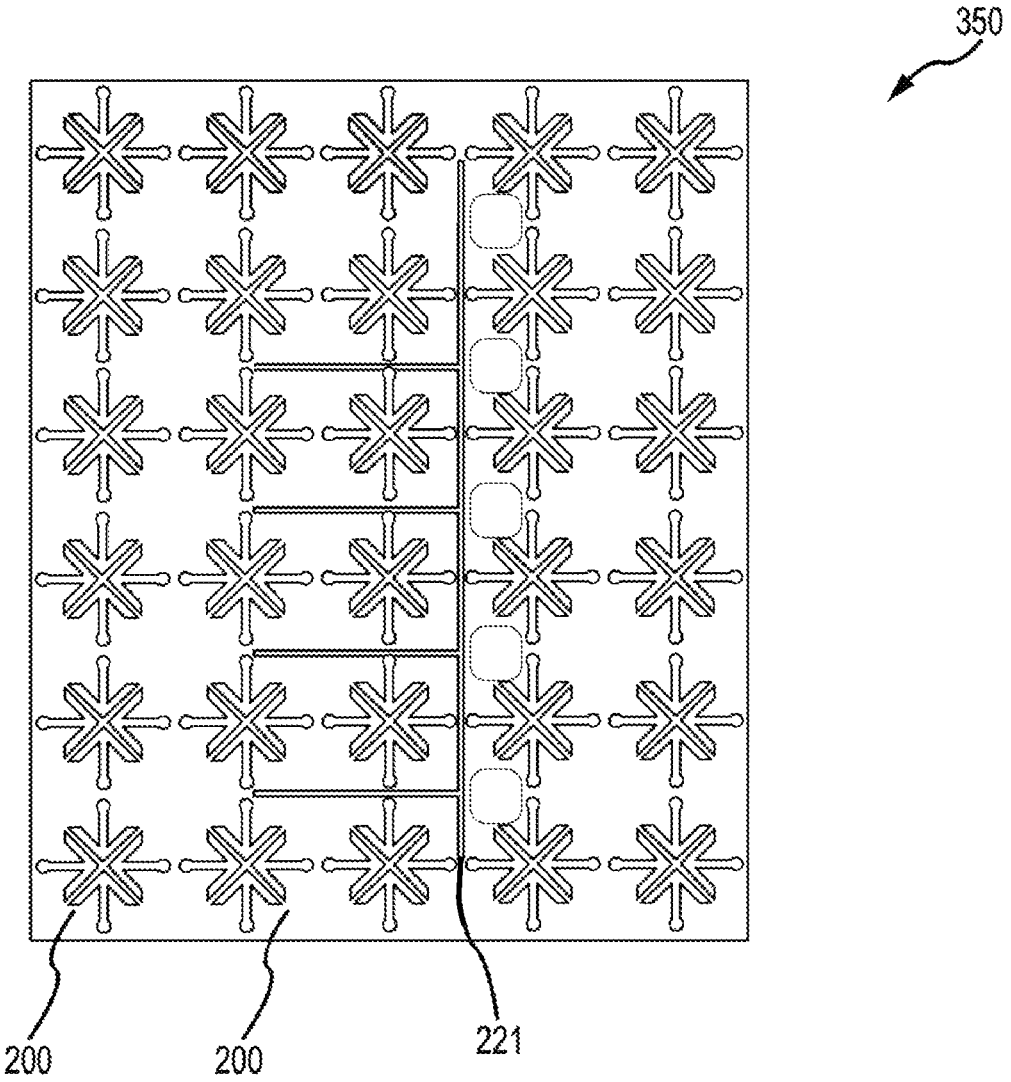
FIG. 3B is a plan view of a current sheet array in accordance with embodiments of the present disclosure.

As illustrated in FIG. 3B, a small, finite current sheet array 350 in accordance with some embodiments may comprise a number of unit cells 200. In such embodiments, certain unit cells 200 may be formed without slots. For example, a current sheet array 350 may comprise one or more unit cells 200 with slots and one or more unit cells 200 without slots. In some embodiments, certain unit cells 200 of a current sheet array 350 may include multiple slots 221. For example, a current sheet array 350 may be formed with a plurality of unit cells 200 in which a single, straight slot 221 is formed or in which a network of slots 221 are arranged in a particular shape in contrast to the current sheet array 300 illustrated in FIG. 3A in which every unit cell 200 includes a slot outlining its perimeter. As should be appreciated by the current sheet array 350 of FIG. 3B, any number of patterns or layouts of slots 221 may be formed by linking unit cells 200 with and/or without slots.

Figure 3C:
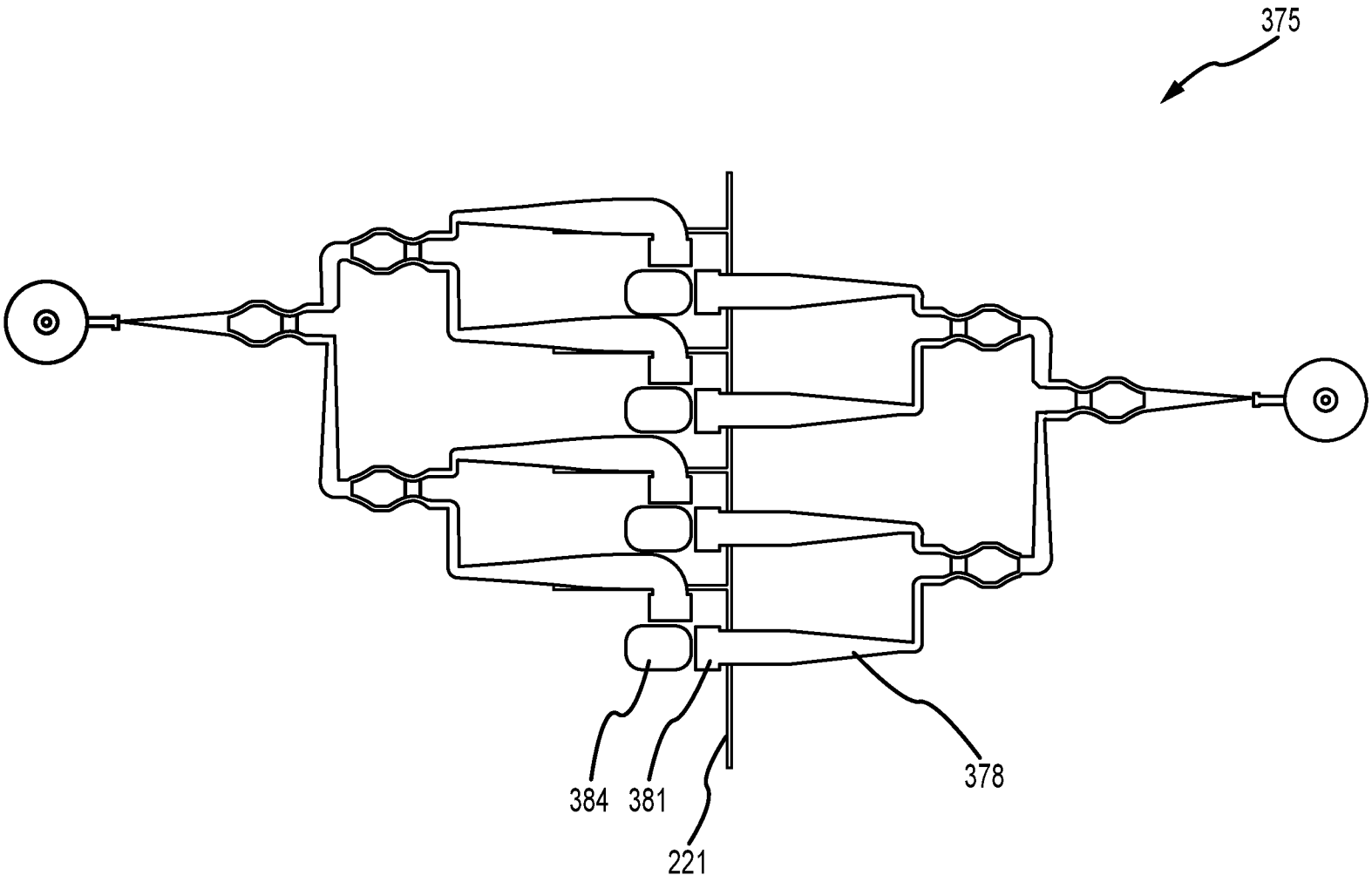
FIG. 3C is a plan view of a current sheet array in accordance with embodiments of the present disclosure.

A reverse view 375 of the current sheet array 350 as illustrated in FIG. 3B is illustrated in FIG. 3C. As can be appreciated, a feed line of the feed pattern 378 may cross over a slot 221 of a unit cell. A feed line of a feed pattern 378 may terminate at an element 384 of a unit cell such as a contact, an electrode, or other type of element 384. After crossing over a slot 221, the feed line of the feed pattern 378 may terminate in the form of a connection point 381.

Each unit cell of a current sheet array may be custom designed with one or more slots such that the current sheet array is formed with unit cells in which the slots line up to form a particular feed pattern. In this way, depending on a desired feed pattern, a current sheet array may be designed with a custom formed slot layout to achieve the desired feed pattern. The layout of the slots 221 of a particular current sheet array 350 may be designed based on a feed pattern 378. While particular layouts are shown in FIGS. 3A-3C, it should be appreciated any number of different layouts may be created based on design choices for particular applications.

Figure 4:
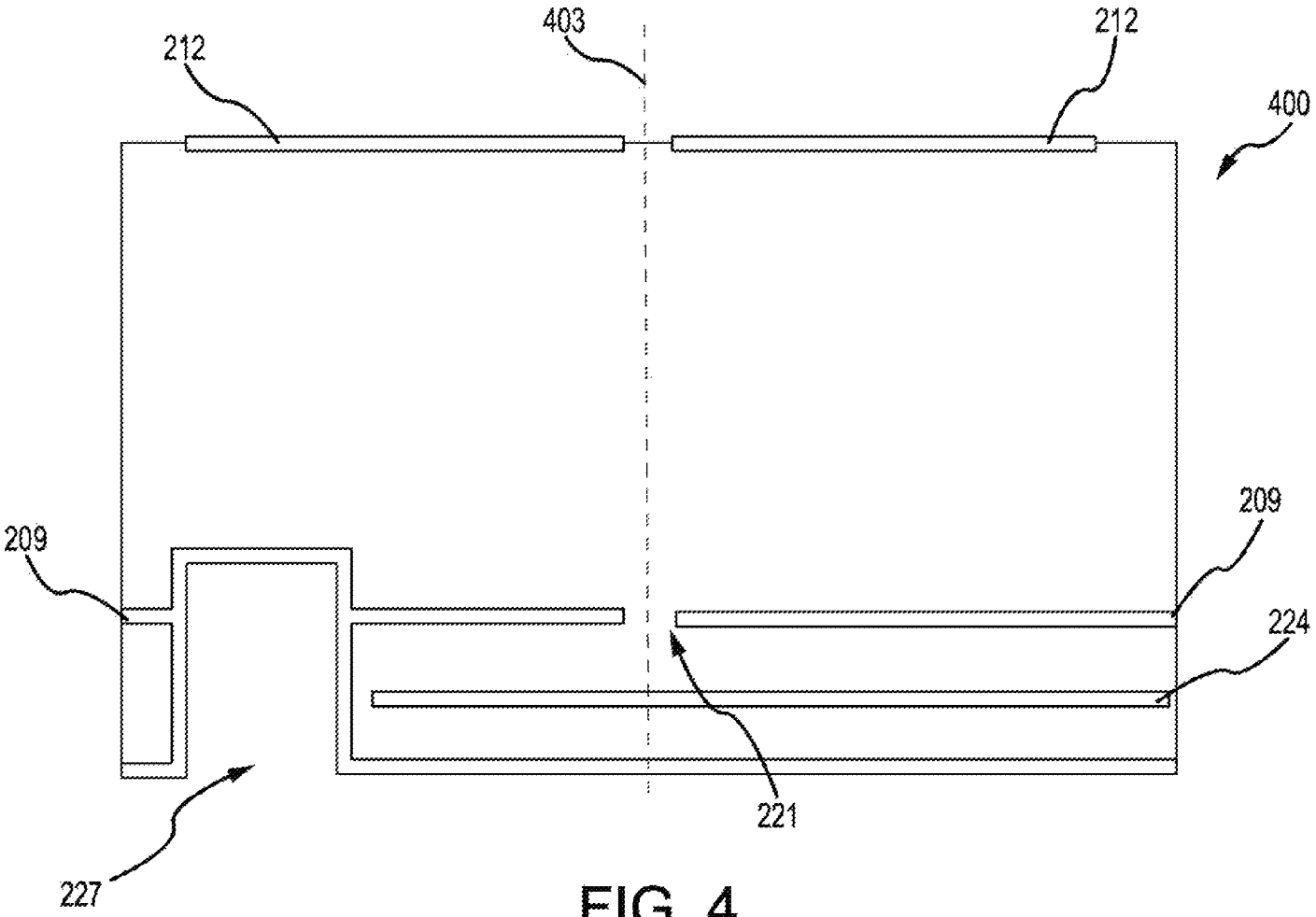
FIG. 4 is a plan view of a portion of a current sheet array in accordance with embodiments of the present disclosure.

A side view of a portion 400 of a current sheet array is illustrated in FIG. 4. The portion 400 of the current sheet array in FIG. 4 illustrates a junction 403 between two unit cells of the current sheet array. As illustrated in FIG. 4, a slot 221 may exist at the junction 403. As can be appreciated, each of the unit cells joining at the junction 403 may be formed with a slot along the edge of the junction 403. In this way, when the unit cells are joined a single slot 221 is formed.

A stripline feed 224 may extend from a side portion of each unit cell. For example, each unit cell of the cells joined at the junction 403 may comprise a stripline feed. When joined, the stripline feeds of each unit cell may join together to form a single stripline feed. The stripline feed 224 may in some embodiments be a low-impedance stripline feed and/or may be capacitively loaded. As can be appreciated by the portion 400 illustrated in FIG. 4, unit cells may or may not further comprise a capacitance area 227 surrounded by the ground plane 209. As should be appreciated, different unit cells making up a single current sheet array may be uniquely formed so that a desired feed pattern or other characteristic of the current sheet array is achieved.

By implementing a slot to between two or more cells of the current sheet array, an electric field in the slot is generated perpendicular to, and between the current sheet array. In this way, a common mode of the current sheet array may be eliminated because the slot mode forces a 180 degree phase difference between each of the dipole arms. By eliminating the common mode, the low-band resonance of the current sheet array can be connected to the dipole mode of the current sheet array to achieve a continuous wideband. Furthermore, by balancing capacitance between elements with the inductance of a loop, a resonant loop may be formed. A stripline feed in a current sheet array may be capable of exciting a mode in a slot which may couple to certain elements of a current sheet array. The fixed slot mode eliminates the excitation of the common mode resonance.

Figure 5A:
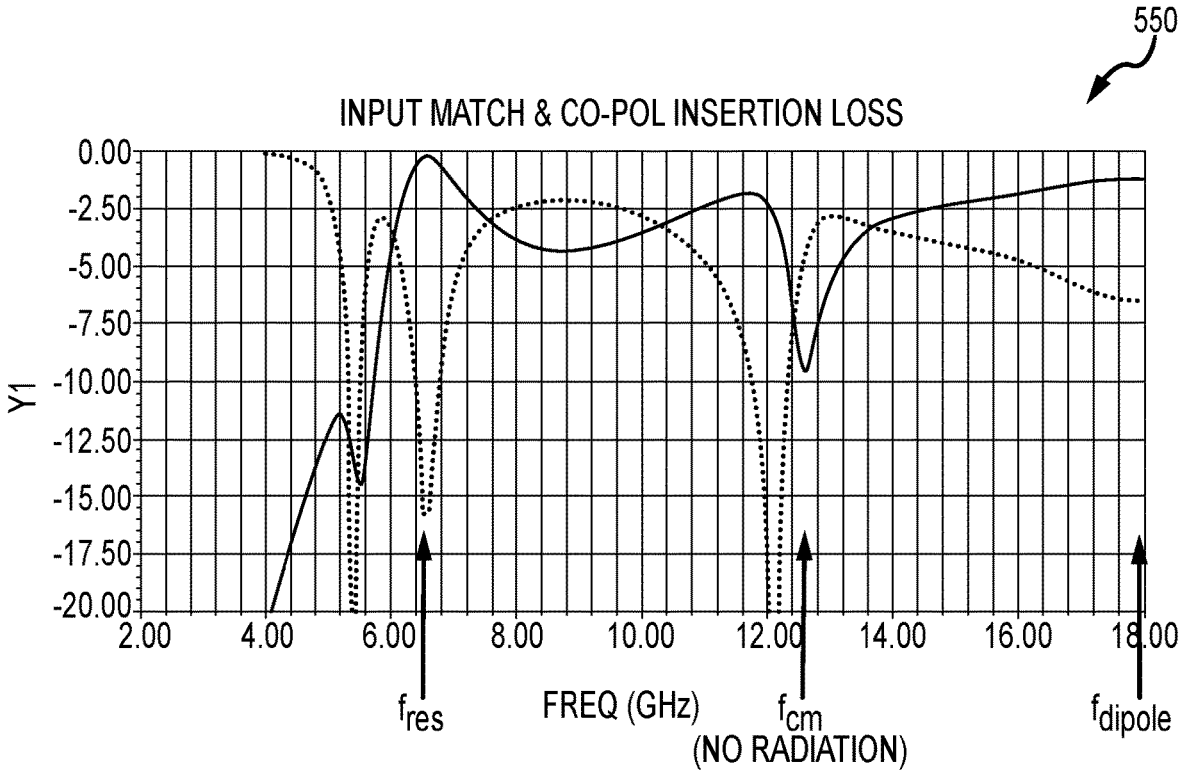
FIG. 5A is a graph illustrating performance of conventional current sheet arrays.

Using a current sheet array as described herein, a current sheet array may be formed without the common mode existing in conventional systems as discussed above. By forming a current sheet array as discussed herein, the common mode may be eliminated. For example, with conventional two-dimensional planar broadband antennas, three modes exist: a radiating resonant mode, a non-radiating common mode, and a radiating dipole mode. An example graph 500 showing input matching and co-pol insertion loss when using a conventional current sheet array is illustrated in FIG. 5A. As can be appreciated, the bandwidth of such systems is limited by a non-radiating common mode which creates two separate bands of frequencies: one around the resonant mode and another around the dipole mode.

As discussed above, a stripline feed may excite a mode in a slot of a current sheet array. The slot mode may couple to the current sheet array, thus forming two radiating modes: a resonant loop and a dipole mode. The fixed slot mode does not excite a common mode of the current sheet array. In this way, the fixed slot mode allows the current sheet array to provide an extremely wide bandwidth as compared to conventional systems. Designing a system in this way enables a current sheet array to be very easy to manufacture, extremely thin, and capable of easily being curved to fit conformal applications.

Figure 5B:
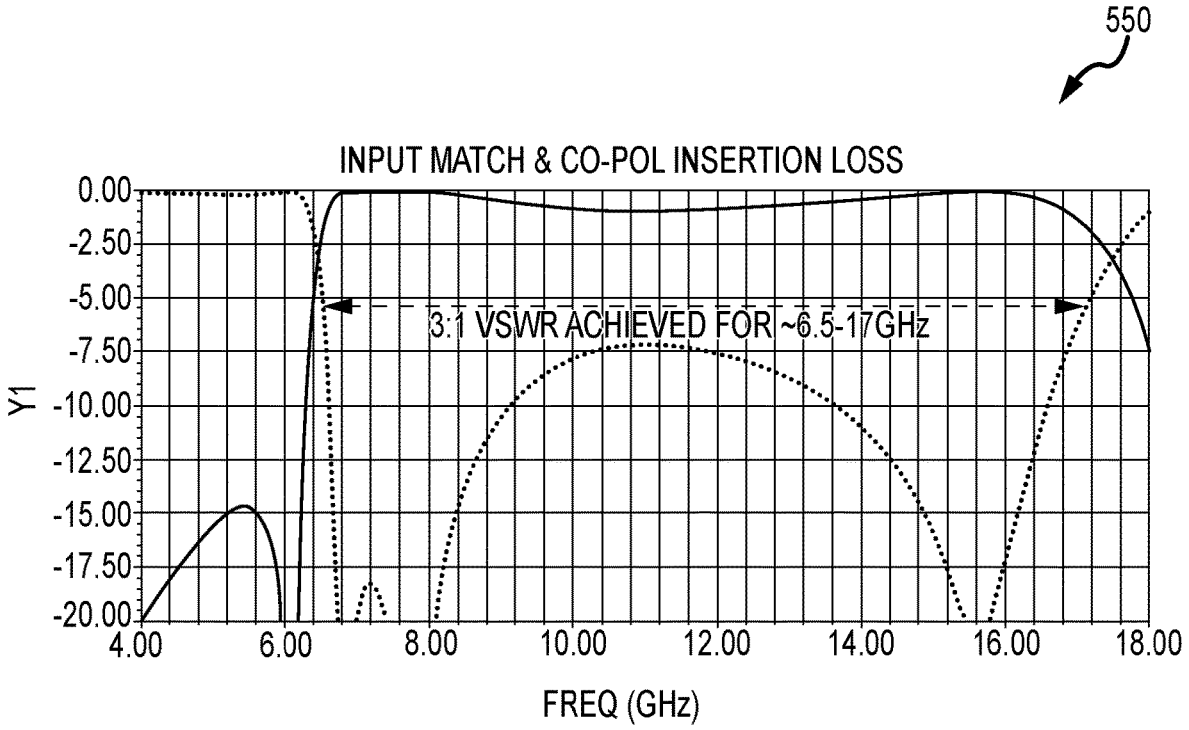
FIG. 5B is a graph illustrating performance of a current sheet array in accordance with embodiments of the present disclosure.

In contrast to using a conventional current sheet array, by using a current sheet array as described herein, the common mode may be eliminated to create a wide-bandwidth, effectively linking the resonant mode and the dipole mode. An example graph 550 showing input matching and co-pol insertion loss when using a current sheet array as described herein is illustrated in FIG. 5B. As can be appreciated, the bandwidth of such systems is enhanced by eliminating the non-radiating common mode of conventional systems. This creates a single, wide band of frequencies, effectively linking the resonant mode and the dipole mode.

Using systems as described herein, by using a slot-coupled feed, the common mode may be eliminated without increasing overall depth of the current sheet array. Such systems may additionally be efficient and simple to manufacture using traditional printed circuit board build processes as compared to conventional systems. The current sheet array design as described herein does not shift the resonant band as in some conventional systems. As such, the current sheet array design as described herein remains electrically small, in which the dipole forms the high-end of the radiation band. current sheet arrays using slot-coupled unit cells as described herein may be used with fixed beam systems, phased arrays, multi-beam arrays, or other types of systems. Such systems may be useful in situations such as high-temperature situations and may be made of any type of material, such as Teflon, ceramic or glass.

Embodiments include a unit cell for use in a current sheet array, the unit cell comprising: a slot; a plurality of dipole arms; and a stripline feed, wherein the stripline feed terminates, wherein the stripline feed and one of the plurality of dipole arms are electrically connected through the slot.

Aspects of the above unit cell include wherein a low-band resonance is connected to a dipole mode to provide a continuous wideband performance.

Aspects of the above unit cell include wherein the unit cell is built with a PCB process.

Aspects of the above unit cell include wherein the stripline feed is capacitively loaded.

Aspects of the above unit cell include wherein the stripline feed excites a mode in the slot.

Aspects of the above unit cell include wherein each unit cell further comprises a capacitance area surrounded by a ground plane.

Aspects of the above unit cell include wherein the unit cell is made of one or more of Teflon, ceramic and glass.

Embodiments include a current sheet array antenna system, comprising: a plurality of unit cells coupled together, wherein each unit cell comprises: a slot; and a stripline feed, wherein the stripline feed terminates at a contact point separated from one of a plurality of dipoles by the slot, wherein the stripline feed and the one of the plurality of dipoles are electrically connected through the slot, wherein an electric field in the slot of a first unit cell is perpendicular to one or more of the stripline feed of the first unit cell and one or more dipoles of the first unit cell.

Aspects of the above current sheet array antenna system include wherein a low-band resonance is connected to a dipole mode to provide a continuous wideband performance.

Aspects of the above current sheet array antenna system include wherein the plurality of cells are connected at the slot of each cell, wherein each slot of each cell is connected and forms a long slot.

Aspects of the above current sheet array antenna system include wherein the stripline feed of each cell is capacitively loaded.

Aspects of the above current sheet array antenna system include wherein the stripline feed of each cell excites a mode in the slot of each cell.

Aspects of the above current sheet array antenna system include wherein each unit cell further comprises a capacitance area surrounded by a ground plane.

Aspects of the above current sheet array antenna system include wherein each unit cell is made of one or more of ceramic and glass.

Embodiments include a method for providing a broadband antenna, comprising: providing a current sheet array, the current sheet array comprising a plurality of unit cells coupled together, wherein each unit cell comprises: a slot; and a stripline feed, wherein the stripline feed terminates at a contact point separated from one of a plurality of dipoles by the slot, wherein the stripline feed and the one of the plurality of dipoles are electrically connected through the slot, wherein an electric field in the slot of a first unit cell is perpendicular to one or more of the stripline feed of the first unit cell and one or more of the plurality of dipoles of the first unit cell.

Aspects of the above method include wherein a low-band resonance is connected to a dipole mode to provide a continuous wideband performance.

Aspects of the above method include wherein the plurality of cells are connected at the slot of each cell, wherein each slot of each cell is connected and forms a long slot.

Aspects of the above method include wherein the stripline feed of each cell is capacitively loaded.

Aspects of the above method include wherein the stripline feed of each cell excites a mode in the slot of each cell.

Aspects of the above method include wherein each unit cell further comprises a capacitance area surrounded by a ground plane.

The foregoing description has been presented for purposes of illustration and description. Further, the description is not intended to limit the disclosed systems and methods to the forms disclosed herein. Consequently, variations and modifications commensurate with the above teachings, within the skill or knowledge of the relevant art, are within the scope of the present disclosure. The embodiments described hereinabove are further intended to explain the best mode presently known of practicing the disclosed systems and methods, and to enable others skilled in the art to utilize the disclosed systems and methods in such or in other embodiments and with various modifications required by the particular application or use. It is intended that the appended claims be construed to include alternative embodiments to the extent permitted by the prior art.

The foregoing discussion of the disclosed systems and methods has been presented for purposes of illustration and description. Further, the description is not intended to limit the disclosed systems and methods to the forms disclosed herein. Consequently, variations and modifications commensurate with the above teachings, within the skill or knowledge of the relevant art, are within the scope of the present disclosure. The embodiments described herein are further intended to explain the best mode presently known of practicing the disclosed systems and methods, and to enable others skilled in the art to utilize the disclosed systems and methods in such or in other embodiments and with various modifications required by the particular application or use. It is intended that the appended claims be construed to include alternative embodiments to the extent permitted by the prior art.

What is claimed is:

1. A unit cell for use in a current sheet array, the unit cell comprising:

a slot;

a plurality of dipole arms; and a stripline feed, wherein the stripline feed and one of the plurality of dipole arms are electrically connected through the slot, wherein an electric field generated in the slot is perpendicular to one or more of the stripline feed and one or more of the plurality of dipole arms, and wherein a low-band resonance is connected to a dipole mode to provide a continuous wideband performance.

2. The unit cell of claim 1, wherein the unit cell is built with a PCB process.

3. The unit cell of claim 1, wherein the stripline feed is capacitively loaded.

4. The unit cell of claim 1, wherein the stripline feed excites a mode in the slot.

5. The unit cell of claim 1, wherein the unit cell further comprises a capacitance area surrounded by a ground plane.

6. The unit cell of claim 1, wherein the unit cell is made of one or more of Teflon, ceramic, and glass.

7. A current sheet array antenna system, comprising:

a plurality of unit cells coupled together, wherein each unit cell comprises:

a slot; and a stripline feed, wherein the stripline feed terminates at a contact point separated from one of a plurality of dipoles by the slot, wherein the stripline feed and the one of the plurality of dipoles are electrically connected through the slot, wherein an electric field in the slot of a first unit cell is perpendicular to one or more of the stripline feed of the first unit cell and one or more dipoles of the first unit cell, and wherein a low-band resonance is connected to a dipole mode to provide a continuous wideband performance.

8. The current sheet array antenna system of claim 7, wherein each of the plurality of cells are connected at the slot of each cell, wherein each slot of each cell is connected and forms a long slot.

9. The current sheet array antenna system of claim 7, wherein the stripline feed of each cell is capacitively loaded.

10. The current sheet array antenna system of claim 7, wherein the stripline feed of each cell excites a mode in the slot of each cell.

11. The current sheet array antenna system of claim 7, wherein each unit cell further comprises a capacitance area surrounded by a ground plane.

12. The current sheet array antenna system of claim 7, wherein each unit cell is made of one or more of ceramic and glass.

13. A method for providing a broadband antenna, comprising:

providing a current sheet array, the current sheet array comprising a plurality of unit cells coupled together, wherein each unit cell comprises:

a slot; and a stripline feed, wherein the stripline feed terminates at a contact point separated from one of a plurality of dipoles by the slot, wherein the stripline feed and the one of the plurality of dipoles are electrically connected through the slot, wherein an electric field in the slot of a first unit cell is perpendicular to one or more of the stripline feed of the first unit cell and one or more of the plurality of dipoles of the first unit cell, and wherein a low-band resonance is connected to a dipole mode to provide a continuous wideband performance.

14. The method of claim 13, wherein each of the plurality of cells are connected at the slot of each cell, wherein each slot of each cell is connected and forms a long slot.

15. The method of claim 13, wherein the stripline feed of each cell is capacitively loaded.

16. The method of claim 13, wherein the stripline feed of each cell excites a mode in the slot of each cell.

17. The method of claim 13, wherein each unit cell further comprises a capacitance area surrounded by a ground plane.

18. The current sheet array antenna system of claim 7, where each using cell is built with a PCB process.

19. The method of claim 13, wherein each unit cell is built with a PCB process.

20. The method of claim 13, wherein each the unit cell is made of one or more of Teflon, ceramic, and glass.

* * * * *